US009631407B2

(12) United States Patent
Wise et al.

(10) Patent No.: US 9,631,407 B2
(45) Date of Patent: Apr. 25, 2017

(54) INSERT ACCESS DOOR

(71) Applicant: Maxam Metal Products Limited, Burnaby (CA)

(72) Inventors: David R. Wise, New Westminster (CA); Kim Thomas Sefton Band, Surrey (CA)

(73) Assignee: Maxam Metal Products Limited, Vancouver (CA)

( * ) Notice: Subject to any disclaimer, the term of this patent is extended or adjusted under 35 U.S.C. 154(b) by 0 days.

(21) Appl. No.: 14/719,056

(22) Filed: May 21, 2015

(65) Prior Publication Data

US 2016/0123068 A1 May 5, 2016

Related U.S. Application Data

(60) Provisional application No. 62/072,722, filed on Oct. 30, 2014.

(51) Int. Cl.

| | |
|---|---|
| ***E06B 3/34*** | (2006.01) |
| ***E05D 7/10*** | (2006.01) |
| ***E05D 7/12*** | (2006.01) |
| ***E04F 19/08*** | (2006.01) |
| *E05D 3/06* | (2006.01) |
| *E05F 1/10* | (2006.01) |

(52) U.S. Cl.
CPC ..... *E05D 7/12* (2013.01); *E04F 19/08* (2013.01); *E05D 3/06* (2013.01); *E05F 1/1091* (2013.01)

(58) Field of Classification Search
CPC .. E06B 3/34; E06B 3/7015; E06B 7/16; E05F 15/53; E05D 7/10; E05D 7/12; E05D 15/00
See application file for complete search history.

(56) References Cited

U.S. PATENT DOCUMENTS 3,721,055 A * 3/1973 Jerchower ..... E06B 1/6015 49/504
4,299,059 A 11/1981 Smith
(Continued)

FOREIGN PATENT DOCUMENTS

DE 4005128 A1 8/1990
EP 668415 A1 9/1995
(Continued)

OTHER PUBLICATIONS

Access Panels and Floor Doors. JL Industries. (12 pages). Available at least as of Oct. 29, 2014.
(Continued)

*Primary Examiner* — Justin Rephann
(74) *Attorney, Agent, or Firm* — Oyen Wiggs Green & Mutala LLP

(57) ABSTRACT

An access door for insertion into an opening in a construction surface is provided. The access door has a frame for engagement with edges of the opening in the construction surface. The frame has a channel formed therein for receiving a thermally insulative material to provide a thermal break between the frame and the construction surface. A door is operatively coupled to the frame and movable between an open position allowing access through the opening in the construction surface and a closed position preventing access through the opening in the construction surface.

19 Claims, 10 Drawing Sheets

(56) References Cited

U.S. PATENT DOCUMENTS

| | | | | |
|---|---|---|---|---|
| 4,593,493 | A | 6/1986 | Naka | |
| 4,685,586 | A * | 8/1987 | Lewis, Jr. | E06B 5/12 220/213 |
| 4,843,789 | A * | 7/1989 | Naka | E04B 9/242 52/204.1 |
| 4,862,658 | A * | 9/1989 | Barker | E06B 1/52 292/340 |
| 5,592,780 | A * | 1/1997 | Checkovich | E05F 3/222 16/49 |
| 6,178,700 | B1 * | 1/2001 | Mayer, Jr. | E06B 1/32 49/504 |
| 6,425,211 | B1 * | 7/2002 | Wise | E05F 1/006 428/209 |
| 8,650,818 | B1 * | 2/2014 | Smith | E06B 1/52 52/211 |
| 2009/0025326 | A1 | 1/2009 | Celli | |
| 2009/0133344 | A1 * | 5/2009 | Harkins | E06B 5/164 52/213 |
| 2010/0275519 | A1 | 11/2010 | Celli | |
| 2011/0105011 | A1 * | 5/2011 | Dubensky | F24F 13/20 454/195 |
| 2012/0042591 | A1 * | 2/2012 | Davis | E06B 7/16 52/210 |
| 2013/0081332 | A1 * | 4/2013 | Baumert | E06B 1/02 49/397 |
| 2013/0097934 | A1 * | 4/2013 | Cook | E05D 15/0686 49/404 |
| 2013/0199116 | A1 * | 8/2013 | D'Agostini | E06B 1/22 52/210 |
| 2014/0069038 | A1 * | 3/2014 | Back | E06B 1/52 52/210 |
| 2015/0082717 | A1 * | 3/2015 | Stevens | E06B 1/347 52/211 |
| 2016/0047161 | A1 * | 2/2016 | Park | E04B 1/941 52/168 |

FOREIGN PATENT DOCUMENTS

| | | | |
|---|---|---|---|
| EP | 1662069 | A1 | 11/2006 |
| EP | 1911496 | A2 | 10/2007 |
| EP | 2474683 | A1 | 1/2012 |
| WO | 2011/095276 | A1 | 8/2011 |

OTHER PUBLICATIONS

Fire Rated Access Panels—Walls and Ceilings Detail and Submittal Sheet. JL Industries Incorporated (2 pages). Available at least as of Oct. 29, 2014.

Submittal/Technical Data Sheet. Cendrex. (1 page). Available at least as of Oct. 29, 2014.

Milcor Commercial Products Groups. Universal fire Rates Access Door. Three Hour Rated Non-combustible Floor/Ceiing Installation. (1 page). Available at least as of Oct. 29, 2014.

Karp Associates, Inc. Access Doors (20 pages). Available at least as of Oct. 29, 2014.

Acudor Products Ltd.—FW-5015 Fire Rated Access Door. (4 pages). Accessed Aug. 5, 2015.

Examiner's Report mailed Aug. 26, 2015 for Canadian Patent Application No. 2892839, filed May 21, 2015.

Response to Examiner's Report mailed Aug. 26, 2015, filed Oct. 28, 2015 for Canadian Patent Application No. 2892839, filed May 21, 2015.

* cited by examiner

INSERT ACCESS DOOR

REFERENCE TO RELATED APPLICATIONS

This application claims the benefit of U.S. provisional patent application No. 62/072,722 filed 30 Oct. 2014 entitled INSERT ACCESS DOOR, the entirety of which is incorporated by reference herein for all purposes.

TECHNICAL FIELD

Some embodiments of the present invention relate to insert access doors that can readily be installed in construction surfaces. Some embodiments of the present invention relate to fire-rated insert access doors that can readily be installed in construction surfaces. Some embodiments of the present invention relate to fire-rated insert access doors that can readily be installed in wood-framed construction surfaces.

BACKGROUND

In building construction, it is often necessary to provide ready access to spaces containing functional building elements behind finished surfaces such as walls and ceilings. For example, access may be required to reach plumbing fixtures, valves on water lines, meters on gas lines, electrical fixtures, switches, circuit breakers, or the like positioned behind a finished building surface such as a wall or ceiling.

Frequently, access is accomplished by providing an opening in the finished construction surface and inserting an access door that can be opened in the opening. The access panel or access door provides access to the space behind the opening. In situations where the access panel or access door is regularly viewed by persons within the building, the access panel or access door may also provide an aesthetically pleasing look consistent with the finished construction surface.

Building codes and/or insurance requirements may mean that walls must possess a certain minimum level of fire and thermal resistance in certain circumstances. The installation of access panels or access doors in a wall can alter the wall's fire and thermal resistance. If the access door or access panel is not designed to resist fire and/or heat, then the fire and thermal resistance of the wall will be lowered.

Fire-rated access doors are frequently made of materials such as metal that have a high thermal conductivity. Installation of a fire-rated access door that will comply with typical building codes requires that the framing of the wall or other construction surface in which the access door is installed be insulated from the frame of the access door to provide a thermal break between the access door frame and the building framing. This is particularly so in the case of buildings having wood-framed construction, where a thermal break is required between a metal frame of the access door and the wood frame of the building.

Often, insulation of the framing at the site where an access door is installed is achieved by lining the opening in which the access door is to be installed with a thermally insulative material such as drywall or gypsum. The thermally insulative material provides a thermal break between the frame of the access door and the frame of the opening in the construction surface. However, installation of such materials is reliant on the installer, and in some cases the installer may forget to install the thermally insulative material, or even intentionally choose not to do so.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides an access door for insertion into an opening in a construction surface. The access door has a frame for engagement with edges of the opening in the construction surface. The frame has a channel formed therein for receiving a thermally insulative material. The channel is positioned so that the thermally insulative material contacts an edge of the construction surface to provide a thermal break between the frame and the construction surface. A door is operatively coupled to the frame and movable between an open position allowing access through the opening in the construction surface and a closed position preventing access through the opening in the construction surface.

The channel can be lined with a thermally insulative material. In some embodiments, the thermally insulative material is drywall. In some embodiments, the access door can be installed with zero clearance against wood framing in the opening in the construction surface. The door can be configured to receive drywall, tile, a sheet of stone or concrete, a sheet of steel, a wood panel, a wall-papered or textured panel, or any other desired finishing material, on the front surface of the door, so that the front surface of the door has an appearance that matches the surrounding construction surface. A mechanical assistor such as a gas cylinder or a spring can be operatively coupled between the frame and the door for helping to actuate the door and/or for holding the door in its closed position.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

As used herein, "front" means the side of an access door that is typically viewed by persons looking at the access door in its installed configuration. "Rear" means the side of an access door that is on the reverse side of a construction surface, which is not generally viewed by persons looking at the access door in its installed configuration.

As used herein, "inward" means the direction towards the centre of the access door, and "outward" means the opposite direction away from the centre of the access door, i.e. toward the edges of the construction surface in which the access door is situated in its installed configuration.

An access door having a frame with a channel formed in the outer periphery thereof for receiving a thermally insulative material is provided. In some embodiments, the access door can be easily installed in an opening in a construction surface by an end user, without the need for the user to separately line the opening with a thermally insulative material to meet applicable fire rating requirements. In some embodiments, the channel in the frame is lined with drywall. In some embodiments, the access door is installed with zero clearance (i.e. in direct contact with a frame of the building). In some embodiments, the access door is installed with zero clearance against wood framing. In some embodiments, the channel in the frame is lined with drywall, and the drywall directly contacts the frame of the building.

Figure 1:
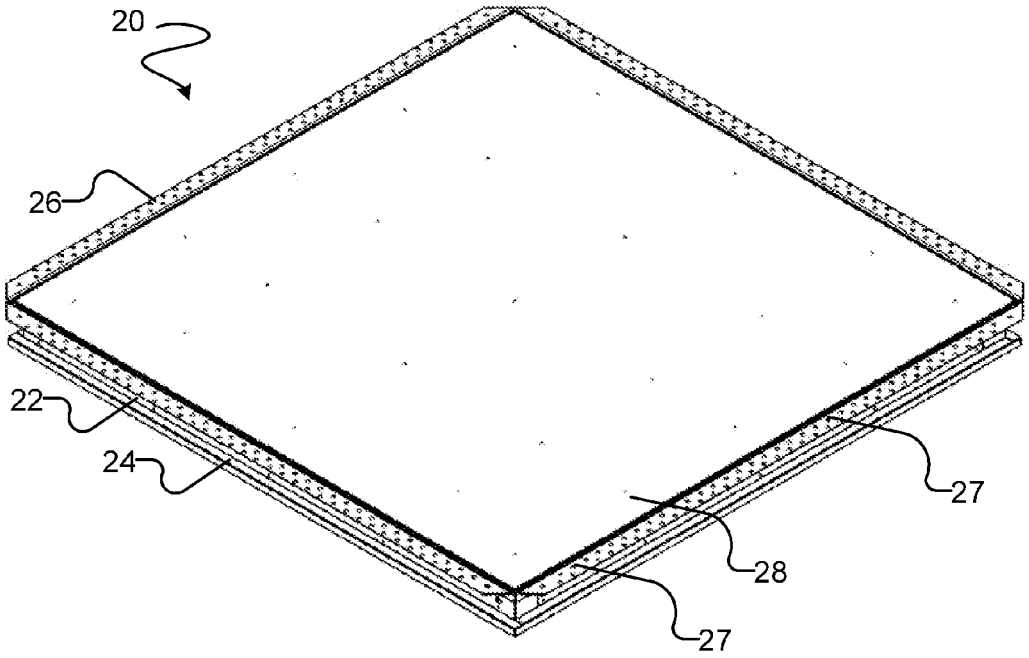
FIG. 1 shows a perspective view of an example embodiment of an insert access door.
Figure 2:
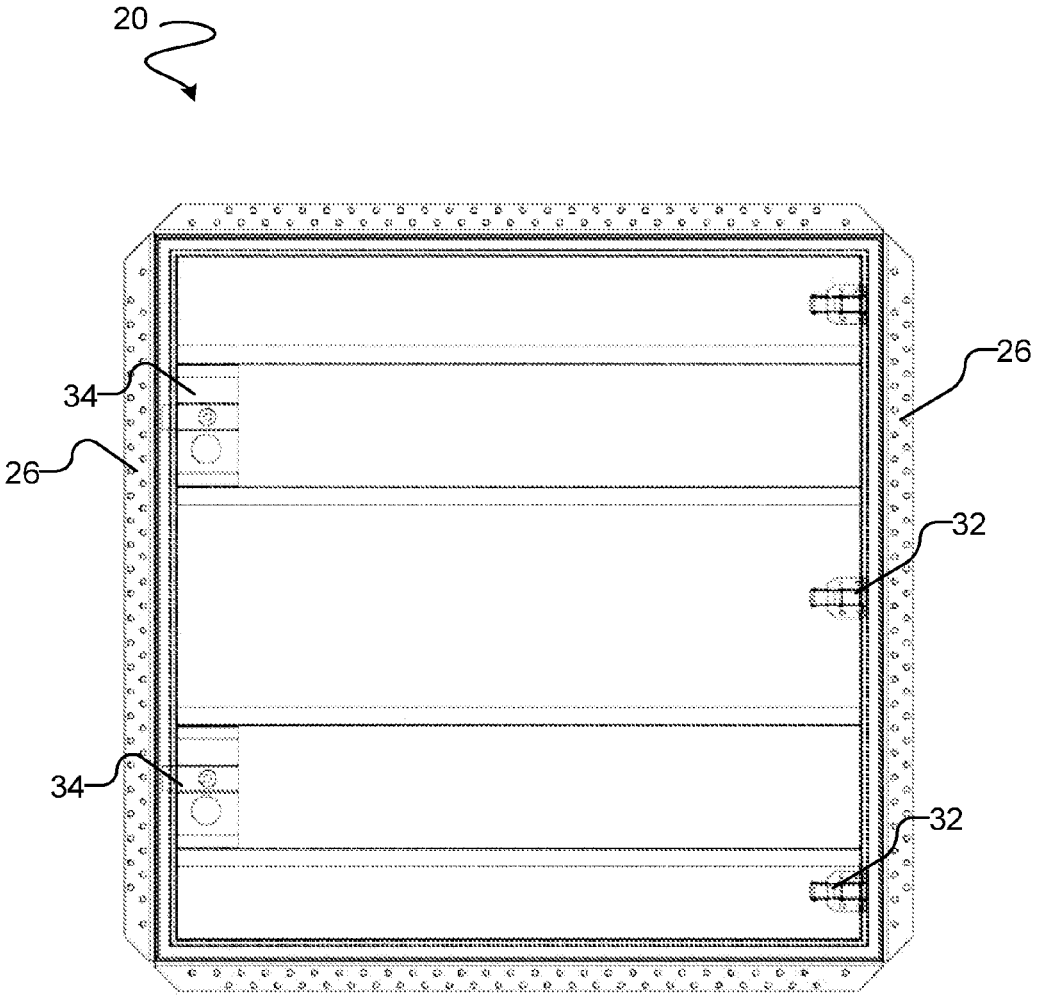
FIG. 2 shows a top view of an example embodiment of an insert access door.

FIGS. 1 and 2 show example embodiments of an insert access door 20 in which like reference numerals are used to refer to like elements. In the illustrated embodiment, access door 20 is intended for installation in a drywall surface, and is intended to aesthetically blend with the surrounding drywall in appearance. Suitable modifications could be made by one skilled in the art to facilitate installation of access door 20 in other types of construction surfaces, e.g. tiled surfaces, steel surfaces, concrete surfaces, or the like.

Figure 3A:
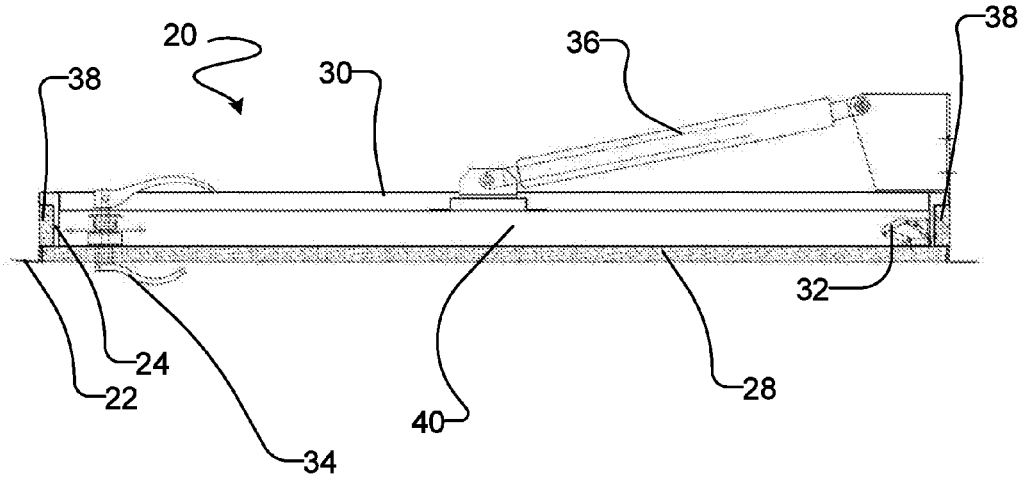
FIG. 3A shows a cross-sectional view of an example embodiment of an insert access door.
Figure 3B:
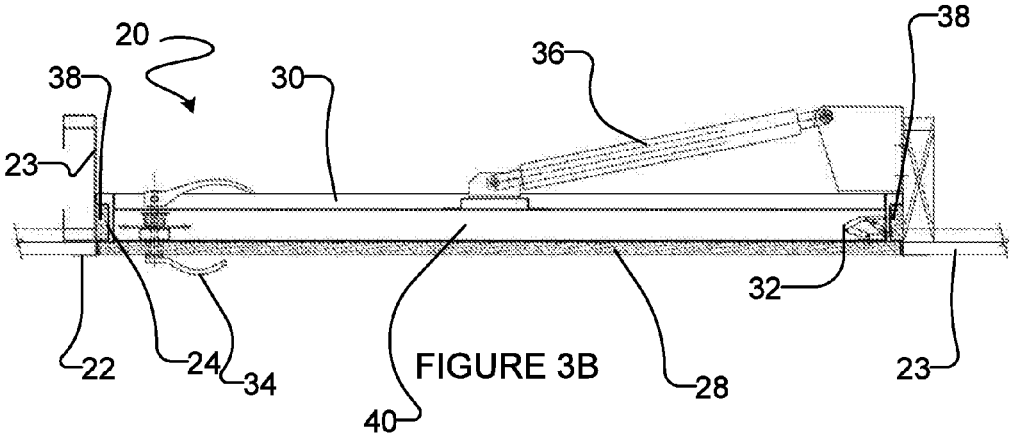
FIG. 3B shows a cross-sectional view of an example embodiment of an insert access door installed in a construction surface.

Insert access door 20 has a frame 22 for installation in an opening in a construction surface 23 (FIG. 3B). Frame 22 has a channel 24 formed along its outside edge for receiving thermally insulative material. As described in more detail below and best seen in FIGS. 4A, 4B, 5 and 6, channel 24 is formed by two side portions 46, 48 that extend inwardly from the portions of frame 22 that contact the construction surface in which frame 22 is installed, and a base portion 44 that extends between the two side portions to form channel 24 in a direction generally parallel to the edge of the opening in the construction surface in which door 20 is installed.

In the illustrated embodiment, access door 20 further includes a drywall taping flange 26 and a drywall door insert 28. Drywall taping flange 26 extends outwardly from frame 22 and is configured to lie generally flush with the front surface of the construction surface in which frame 22 sits. For example, in embodiments in which access door 20 is inserted into an opening in drywall, drywall taping flange 26 is positioned and configured to lie generally flush with the drywall surrounding the opening, so that tape and/or drywall compound can be readily applied to drywall taping flange 26. In some embodiments, drywall taping flange 26 includes a plurality of apertures 27 formed therethrough. Apertures 27 can assist in receiving and/or securing drywall compound to drywall taping flange 26.

Used together or independently, drywall taping flange 26 and drywall door insert 28 are features that facilitate the incorporation of access door 20 into a construction surface comprising drywall in an aesthetically pleasing manner. In alternative embodiments intended for incorporation in other construction surfaces besides drywall, drywall door insert 28 could be replaced with another suitable material, for example, tile, a sheet of stone or concrete, a sheet of steel, a wood panel, a wall-papered or textured panel, or the like, to match the construction surface into which the access door 20 is to be incorporated.

FIG. 3A shows a cross-sectional view of an example embodiment of an insert access door 20. A door 30 is operatively coupled to frame 22 in any suitable manner, for example using one or more hinges 32. Any suitable hinge mechanism can be used to provide hinges 32, for example, a continuous piano hinge, extension hinge, or the like. FIG. 3B shows a cross-sectional view of an example embodiment of an access door similar to insert access door 20 (in which like reference numerals refer to like elements) installed in an opening in a construction surface 23.

Door 30 is movable between an open position in which door 30 is positioned to allow access through frame 22 and a closed position, in which door 30 is positioned to prevent access through frame 22. In some embodiments, the angle through which door 30 is permitted to rotate (i.e. the angle between the closed position and the open position) is restricted. For example, in one example embodiment of an access door intended for use in ceiling applications, where gas cylinders are provided to assist in opening the door, the maximum angle through which the door is permitted to rotate is just under 90 degrees, for example 88 degrees in one example embodiment. In another example embodiment of an access door intended for use in wall applications in which a spring is provided to assist in opening the door, the maximum angle through which the door is permitted to rotate is approximately 90 degrees. In alternative embodiments, the maximum angle through which the door is permitted to rotate is not limited, and the degree to which the door could open would depend on interference with other components of the construction surface in which access door 20 is installed.

In the illustrated embodiment, one or more securing mechanisms 34 are provided to secure door 30 in the closed position. Any suitable securing mechanism can be used to provide securing mechanism 34, for example, a cylinder key lock, an Allen (hex) key cylinder cam latch, a non-locking two position handle, or the like. In some embodiments, one or more securing mechanisms 34 are provided along an edge of door 30 opposite to hinges 32.

In some embodiments, a mechanical assistor can be provided to assist in moving door 30 between the open and closed positions. In the illustrated embodiment, one or more gas cylinders 36 are provided at the rear of door 30 to assist in moving door 30 between the open and closed positions. Any suitable type of spring mechanism or other mechanical assistor can be provided in place of gas cylinders 36 as may be suitable for any given application, for example, a spring could be used. In some embodiments, gas cylinders are used for access doors that are intended for use in ceiling applications. In some embodiments intended for ceiling applications in which a relatively smaller and lighter door is used, a spring is used. In some embodiments intended for use in wall applications (where the weight of the door is applied to the frame vertically rather than horizontally), a spring is used. In some embodiments, the spring is attached to the frame 22 and to the rear of door 30.

In some embodiments, to comply with applicable fire regulations, a spring mechanism such as a gas cylinder or a spring is used to pull door 30 to a closed position when door 30 is released. In this way, the default position of door 30 is the closed position, and a user must open the securing mechanism and manually move door 30 to the open position.

As can be seen in FIG. 3A, a thermally insulative material can be inserted in channel 24. In the illustrated embodiment, portions of drywall 38 have been inserted and secured in channel 24, and the drywall 38 provides the thermally insulative material. In other embodiments, other types of thermally insulative material could be inserted into channel 24, for example, mineral wool, Rockwool™, concrete board, an intumescent seal, a non-combustible fiber insulation, a non-combustible acoustic insulation, or the like. The thermally insulative material can be secured in channel 24 in any suitable manner, for example by using suitable fasteners such as screws or bolts, suitable adhesives, tape or the like.

As best seen in FIG. 1, channel 24, and thus the thermally insulative material such as drywall 38, extends substantially around the perimeter of frame 22. When access door 20 is installed in an opening in a construction surface, frame 22 is positioned so that the thermally insulative material contained in channel 24, for example drywall 38, contacts the edges of the opening in the construction surface in which access door 20 is installed. In this way, the thermally insulative material contained in channel 24, for example drywall 38, provides a thermal break between frame 22 and the opening in the construction surface (for example, between frame 22 and the framing of a wall in which insert access door 20 is installed).

In some embodiments, thermally insulative material is provided within a cavity 40 within door 30, as described in more detail below. Cavity 40 may be filled with any suitable thermally insulative material and/or non-flammable material, for example mineral wool, Rockwool™, concrete board, an intumescent seal, a non-combustible fiber insulation, a non-combustible acoustic insulation, or the like.

Figure 4A:
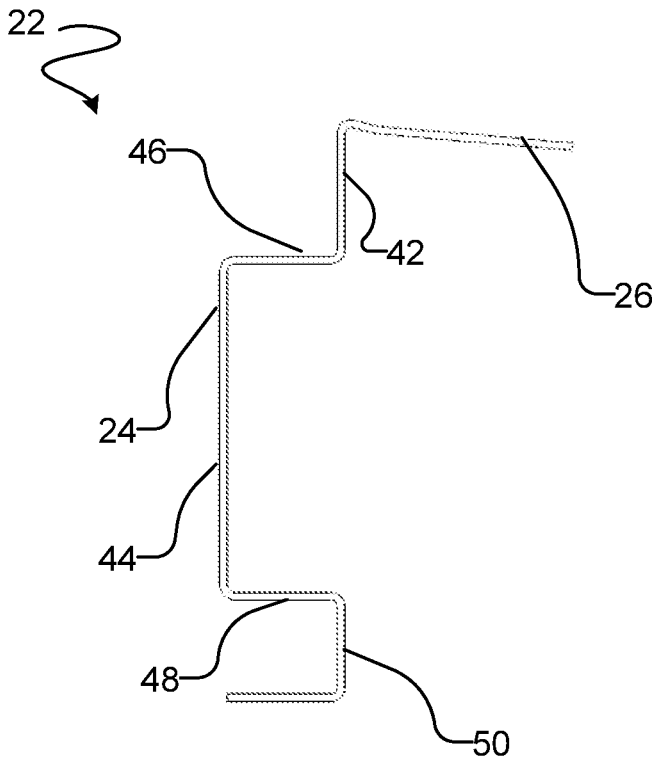
FIG. 4A shows a cross-sectional view of a portion of a frame of an insert access door according to an example embodiment.
Figure 4B:
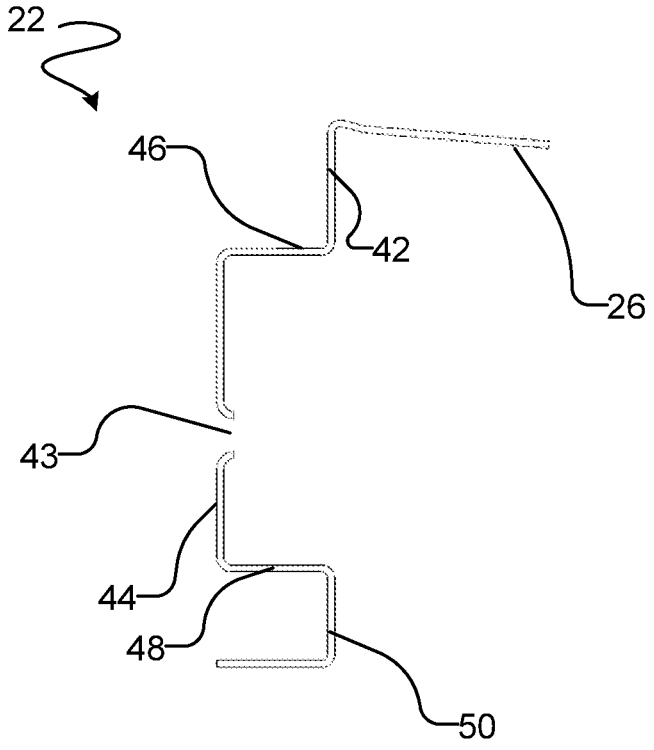
FIG. 4B shows a cross-sectional view of a portion of a frame of an insert access door according to an example embodiment, showing an aperture through the frame for mounting the frame on a construction surface.

FIG. 4A shows a cross-sectional view of an example embodiment of frame 22. In this example embodiment, drywall taping flange 26 is connected to channel 24 by a connecting portion 42 that extends in a direction parallel to a first edge of an opening in a construction surface into which frame 22 is to be inserted. Channel 24 has a base portion 44 that also extends generally parallel to the first edge of an opening in the construction surface into which frame 22 is to be inserted, but is inwardly recessed with respect to connecting portion 42 by two opposing side portions 46, 48 to form channel 24. A rear portion 50 of frame 22 extends rearwardly from side portion 48, and includes a portion extending generally parallel to an edge of an opening in the construction surface into which frame 22 is to be inserted, and intended to lie flush with the opening.

While in the foregoing paragraph portions 42, 44 and 50 have been described as extending generally parallel to an edge of the opening in the construction surface into which frame 22 is to be inserted, it will be obvious to one skilled in the art that these portions would typically be configured to conform with the shape of the opening. Thus, if the shape of the opening is uneven or varied, the shape of these components could be varied to correspond to different shapes of openings.

Generally when frame 22 is in the installed configuration, portions 42 and 50, as well as drywall taping flange 26, will contact the construction surface. In embodiments in which a thermally insulative material such as drywall 38 is used, drywall 38 will generally also contact the construction surface. In this way, the thermally insulative material, such as drywall 38, provides a thermal break between frame 22 and the construction surface.

In some embodiments, portions 42, 44 and/or 50 are provided with apertures for receiving fasteners (for example, nails or screws) to secure frame 22 in place within the construction surface. For example, such an aperture 43 is shown in the cross-sectional view of FIG. 4B, located in base portion 44 of frame 22. In some embodiments, apertures 43 are counter-sunk so that the top surface of the fastener sits generally flush with the inside surface of portion 42, 44 or 50. In some embodiments, other mechanisms such as friction or suitable adhesives could be used to secure frame 22 in the installed configuration within an opening in a construction surface.

Figure 5:
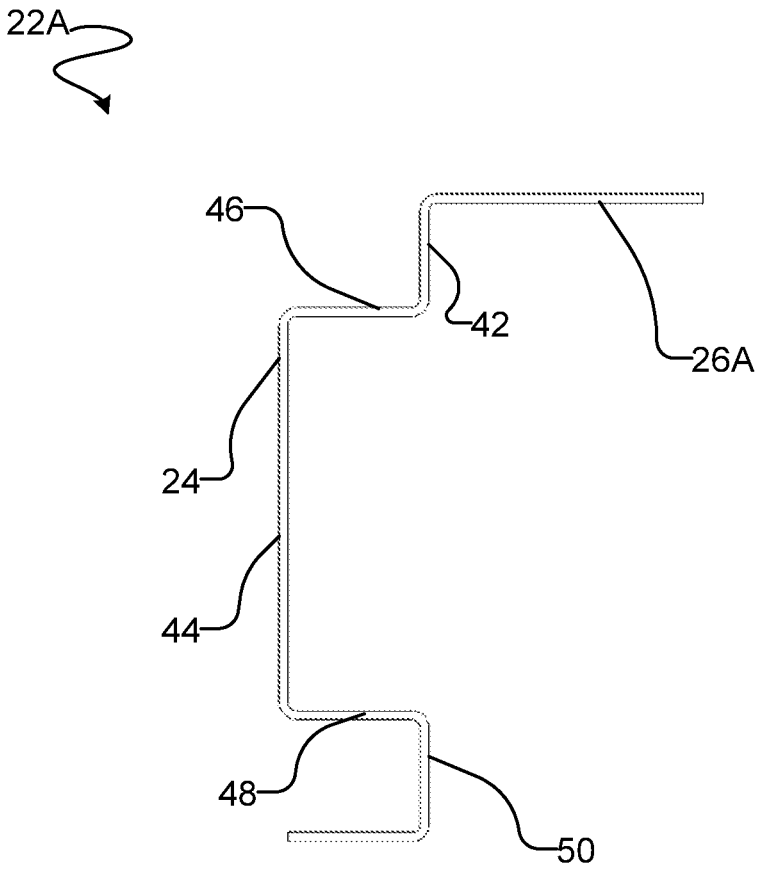
FIG. 5 shows a cross-sectional view of a portion of a frame of an insert access door according to a further example embodiment.

FIG. 5 shows a cross-sectional view of a second example embodiment of frame 22A. Frame 22A is generally similar to frame 22, except that frame 22A does not include a drywall taping flange. Instead, frame 22A is provided with a plain flange 26A. The remaining elements of frame 22A are generally the same as those of frame 22, and are illustrated with like reference numerals. In some embodiments, drywall taping flange 26 and/or plain flange 26A are omitted altogether.

Figure 6:
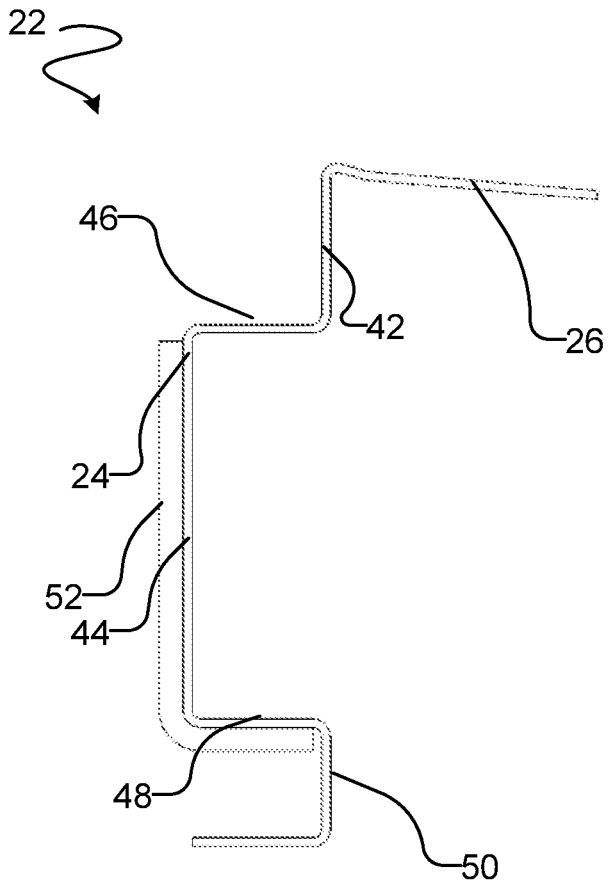
FIG. 6 shows a cross-sectional view of a portion of a frame of an insert access door adjacent the hinge side of the door in an example embodiment.

FIG. 6 shows a cross-sectional view of a portion of frame 22 that is provided adjacent the hinge side of door 30. In some embodiments, a spacer 52 is provided alongside at least a portion of channel 24 adjacent the hinge side of door 30 (i.e. adjacent the side about which door 30 rotates between the open and closed positions) to increase the clearance of hinge 32 from frame 22. In the illustrated embodiment, spacer 52 is a generally L-shaped portion of material that extends inwardly adjacent base portion 44 and side portion 48 of channel 24. Spacer 52 sits between base portion 44 and hinge 32, to provide additional space between hinge 32 and the construction surface. Such a configuration may be particularly useful in some embodiments where it is desired to have door 30 open more than 90°, e.g. when door 20 is installed in a wall. Spacer 52 can be made of any suitable material, e.g. metal, and can be provided with a suitable thickness to ensure that door 30 opens to at least a desired predetermined angle. In some embodiments, spacer 52 may increase the strength of frame 22 on the side where it is installed.

Figure 7:
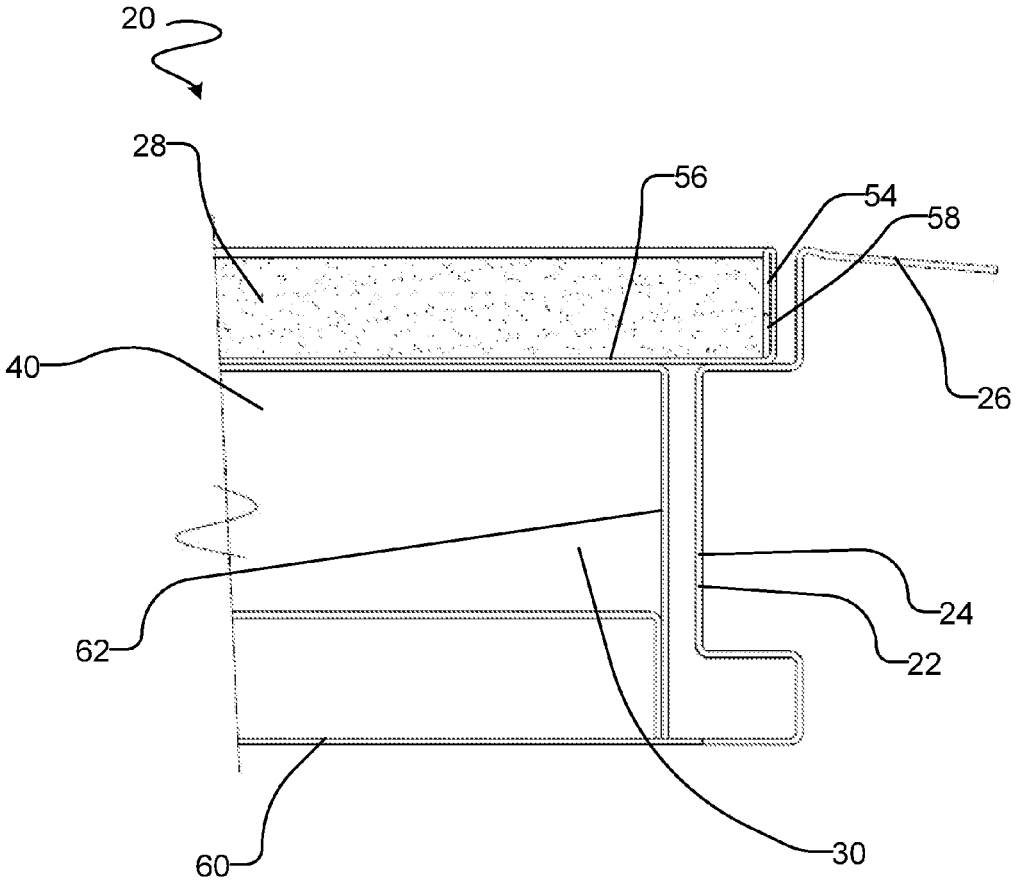
FIG. 7 shows a partial cross-sectional view of an embodiment of an insert access door having a frame in accordance with the embodiment shown in FIG. 4A.

FIG. 7 shows a cross-sectional view of a portion of an access door having a frame in accordance with the example embodiment illustrated in FIG. 4A. In the illustrated embodiment, door 30 is in the closed position. A drywall pan 54 is provided with a correspondingly shaped recess for receiving drywall door insert 28. In the illustrated embodiment, drywall pan 54 has a rear surface 56 that sits generally parallel to drywall door insert 28 or other visually appealing material matching the construction surface (e.g. other construction materials such as tiles, steel panels, concrete, wood panels, or the like) when drywall door insert 28 is in its installed position. Drywall door insert engaging members extend forwardly from rear surface 56 to engage and secure drywall door insert 28 in its installed position. In the illustrated embodiment, four forwardly projecting sides 58 extend from rear surface 56 and are positioned and configured to engage with the outer peripheral edges of drywall door insert 28. Drywall door insert 28 is secured within drywall pan 54 in any suitable manner, for example by appropriate fasteners such as screws, using a suitable adhesive (which is a non-combustible adhesive in some embodiments), or the like.

In the illustrated embodiment, the front edge of drywall pan 54 and the front edge of drywall door insert 28 are approximately evenly positioned relative to drywall taping flange 26, so that the front edge of door 30 and frame 22 will appear visually unobtrusive when the construction surface into which access door 20 is inserted is viewed.

The rearward portion of door 30 includes a liner pan 60. In some embodiments, liner pan 60 acts as a cover for any insulation installed in door 30. An insulation pan 62 is also provided so that insulation can be inserted into the interior cavity 40 of door 30 if desired. Any suitable insulative material can be inserted into interior cavity 40, for example mineral wool, Rockwool™, concrete board, an intumescent seal, a non-combustible fiber insulation, a non-combustible acoustic insulation, or the like.

Figure 8:
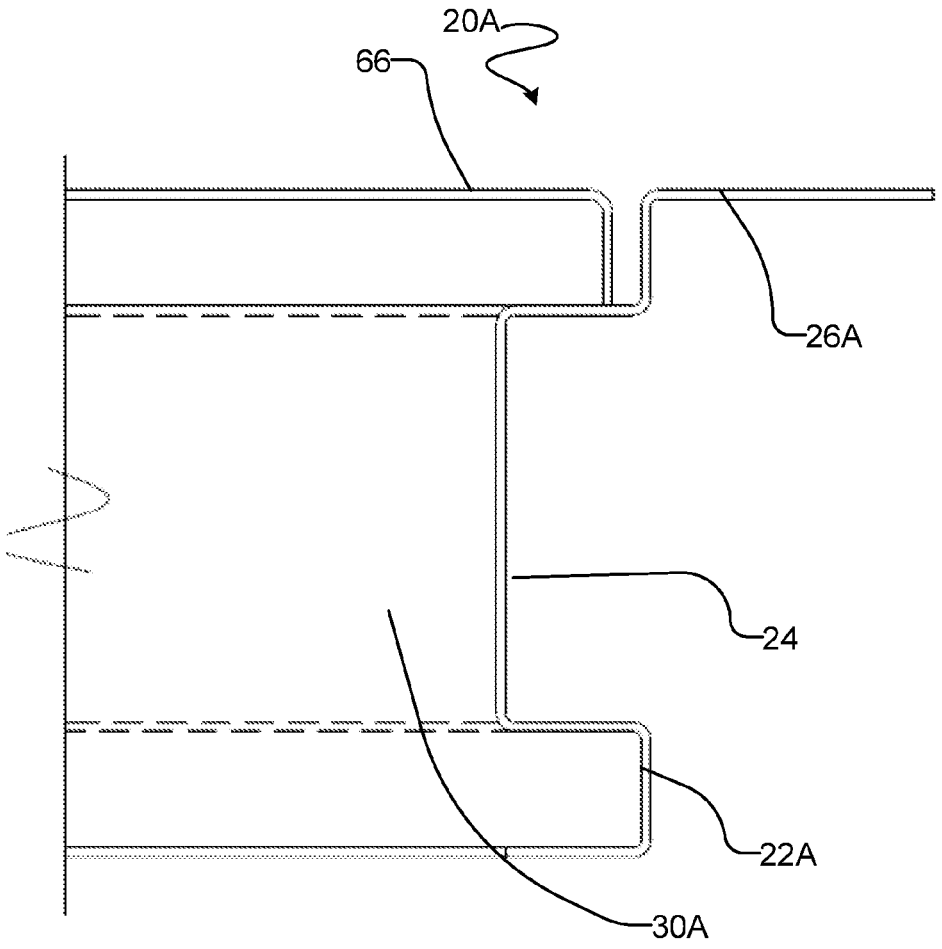
FIG. 8 shows a partial cross-sectional view of an embodiment of an insert access door having a frame in accordance with the embodiment shown in FIG. 5.

FIG. 8 shows a cross-sectional view of a portion of an insert access door 20A having a frame corresponding to the embodiment of a frame illustrated in FIG. 5. In the illustrated embodiment, frame 22A has a plain flange 26A and door 30A has a metal door pan 66. In some embodiments, a metal door pan 66 is used when access door 20 is intended for use in un-insulated applications. In some embodiments, both a metal door pan 66 and a plain flange 26A are used when access door 20 is intended for use in un-insulated applications. In some embodiments, metal door pan 66 is used together with a drywall taping flange 26.

Figure 9:
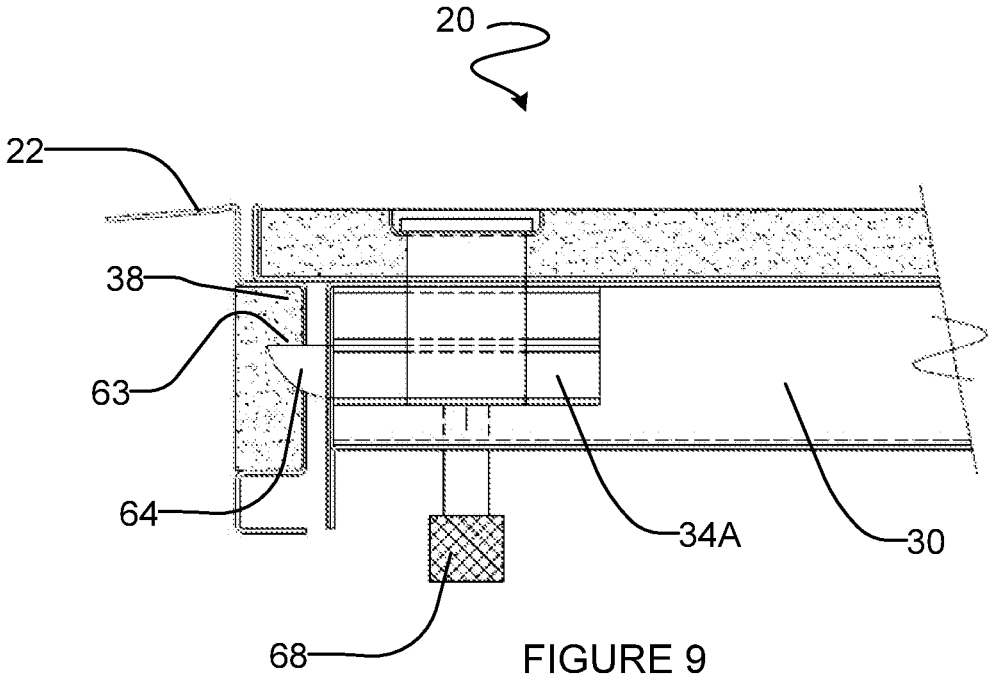
FIG. 9 shows a partial cross-sectional view illustrating the engagement of a latch with a receptacle in the insulative material lining the channel in the frame of the access door.

With reference to FIG. 9, an example installation of a latch 34A for securing door 30 in the closed position is illustrated. An aperture can be provided through frame 22 and a receptacle 63 provided in drywall portions 38 for receiving the latching element 64 of latch 34A. A handle 68 or other suitable actuator can be provided to allow actuation of latching element 64, to allow door 30 to be moved from the closed position to the open position by a user. In some embodiments, for example as illustrated in FIG. 3A, a handle can be provide on both the front and rear sides of door 30, to allow door 30 to be opened from either the front or the rear of the construction surface in which insert access door 20 is installed. In some embodiments, including the illustrated embodiment, the securing mechanism 34 is provided on the side of door 30 opposite to hinges 32.

Without being bound by theory, it is believed that an access door with a frame having a channel formed in the outer periphery thereof can be made lighter than conventional access door frames because the profile is more rigid. This allows for the construction of access door 20 with a lighter gauge metal, and allows for the use of a lighter door 30, if desired. For example, some typical access doors may use 14 gauge metal plate for fabrication of its frames (a 14 gauge metal plate has a thickness of 0.0785 inches and a weight of 3.281 pounds per square foot). In some embodiments of the present invention, the inventors anticipate that a 20 gauge metal plate can be used to fabricate the frame of the access door (a 20 gauge metal plate has a thickness of 0.0396 inches and a weight of 1.656 pounds per square foot), making it possible to provide an access door that is almost half the weight of a conventional access door, but with similar strength.

Insert access door 20 can be installed in any type of opening depending on the desired application. In some embodiments, insert access door 20 is installed in a roof. In some embodiments, insert access door 20 is installed in a wall. In some embodiments, insert access door 20 has a fire rating of 1 hour, 2 hours or 3 hours.

In some embodiments, a portion of drywall is provided in drywall pan 54. In some embodiments, such drywall is mudded over so that the front face of the access door is textured to match a surrounding surface, for example, a textured ceiling.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

What is claimed is:

1. An access door for insertion into an opening in a construction surface, the access door comprising:
   - a frame for engagement with edges of the opening in the construction surface, the frame having a channel formed therein, the channel having a cross-sectional profile in a plane that is perpendicular to a longitudinal axis of the frame, the cross-sectional profile comprising:
     - a first side portion extending inwardly from a front portion of the frame, the front portion of the frame being adapted to contact a corresponding one of the edges of the opening in the construction surface;
     - a second side portion extending inwardly from a rear portion of the frame, the rear portion of the frame being adapted to contact the corresponding one of the edges of the opening in the construction surface; and
     - a base portion connecting the first and second side portions, the base portion extending generally parallel to the corresponding one of the edges of the opening in the construction surface;
     - the front portion comprising an elongate portion extending parallel to the base portion and the rear portion comprising an elongate portion extending parallel to the base portion; and
     - a thermally insulative material lining the channel, so that the thermally insulative material will provide a thermal break between the frame and the edges of the opening in the construction surface; and
   - a door operatively coupled to the frame and movable between an open position allowing access through the opening in the construction surface and a closed position preventing access through the opening in the construction surface.

2. An access door as defined in claim 1, wherein the channel is configured and disposed so that the thermally insulative material will contact the edges of the opening in the construction surface.

3. An access door as defined in claim 1, wherein the thermally insulative material comprises drywall.

4. An assembly comprising an access door as defined in claim 3 and the opening in the construction surface, the access door being installed with zero clearance against a wood portion of the edges of the opening in the construction surface.

5. An access door as defined in claim 1, wherein the construction surface comprises drywall, the frame comprises a front edge extending from the front portion of the frame, and wherein the front edge comprises a drywall taping flange.

6. An access door as defined in claim 5, wherein the door is shaped to receive a drywall door insert on a front face of the door.

7. An access door as defined in claim 6, wherein a sheet of drywall is provided on the front face of the door.

8. An access door as defined in claim 1, wherein a front surface of the door comprises drywall, tile, a sheet of stone or concrete, a sheet of steel, a wood panel, or a wall-papered or textured panel.

9. An access door as defined in claim 1, comprising at least one hinge coupling the door to the frame.

10. An access door as defined in claim 9, comprising a latch for securing the door in a closed position.

11. An access door as defined in claim 10, wherein the latch is provided on a side of the door opposite to the hinge.

12. An access door as defined in claim 11, comprising a spacer mounted on an inside edge of the frame for spacing the hinge from the frame.

13. An access door as defined in claim 12, comprising a mechanical assistor operatively coupled between the frame and the door for helping to actuate the door.

14. An access door as defined in claim 13, wherein the mechanical assistor comprises a gas cylinder or a spring.

15. An access door as defined in claim 14, wherein the mechanical assistor holds the door in the closed position.

16. An access door as defined in claim 1, wherein the channel extends substantially around a perimeter of the frame.

17. An access door as defined in claim 1, wherein the thermally insulative material comprises a non-combustible material.

18. A method of installing an access door in an opening in a construction surface, the method comprising the steps of:

providing a frame for engagement with edges of the opening in the construction surface, the frame having a channel formed therein, the channel having a cross-sectional profile in a plane that is perpendicular to a longitudinal axis of the frame, the cross-sectional profile comprising:

a first side portion extending inwardly from a front portion of the frame, the front portion of the frame being adapted to contact a corresponding one of the edges of the opening in the construction surface;

a second side portion extending inwardly from a rear portion of the frame, the rear portion of the frame being adapted to contact the corresponding one of the edges of the opening in the construction surface;

a base portion connecting the first and second side portions, the base portion extending generally parallel to the corresponding one of the edges of the opening in the construction surface;

the front portion comprising an elongate portion extending parallel to the base portion and the rear portion comprising an elongate portion extending parallel to the base portion;

providing a door operatively coupled to the frame and movable between an open position allowing access through the opening in the construction surface and a closed position preventing access through the opening in the construction surface;

inserting a thermally insulative material in the channel formed in the frame;

inserting the frame in the opening in the construction surface so that the thermally insulative material is disposed between the construction surface and the frame to provide a thermal break; and securing the frame in the opening in the construction surface.

19. A method as defined in claim 18, wherein the thermally insulative material comprises drywall.

* * * * *